US005974970A

United States Patent [19]

Izume

[11] Patent Number: 5,974,970

[45] Date of Patent: Nov. 2, 1999

[54] INKING ARRANGEMENT FOR PRINTING PRESSES

[75] Inventor: Masayuki Izume, Kyoto, Japan

[73] Assignee: I. Mar Planning Inc., Kyoto, Japan

[21] Appl. No.: 09/084,784

[22] Filed: May 27, 1998

Related U.S. Application Data

[60] Division of application No. 08/559,176, Nov. 13, 1995, Pat. No. 5,823,110, which is a continuation-in-part of application No. 08/277,066, Jul. 19, 1994, abandoned.

[30] Foreign Application Priority Data

Jul. 20, 1993 [JP] Japan ..... 5-178864
Sep. 10, 1993 [JP] Japan ..... 5-226074

[51] Int. Cl.[6] ..... B41F 31/06; B41F 31/04

[52] U.S. Cl. ..... 101/350.1; 101/425

[58] Field of Search ..... 101/363, 350, 101/366, 365, 148, 350.1, 349, 350.6, 351.3, 352.01, 352.04, 352.09, 423, 424, 425; 118/261; 15/256.51, 256.52

[56] References Cited

U.S. PATENT DOCUMENTS

| | | | |
|---|---|---|---|
| 3,318,239 | 5/1967 | Wintzer | 101/364 |
| 3,635,161 | 1/1972 | Leanna | 101/208 |
| 4,254,709 | 3/1981 | Arnolds | 101/425 |
| 4,699,055 | 10/1987 | Jeschke | 101/350 |
| 5,184,556 | 2/1993 | Schaeuble | 101/483 |

FOREIGN PATENT DOCUMENTS

| | | |
|---|---|---|
| 0043089 A1 | 1/1982 | European Pat. Off. . |
| 0223972 A2 | 6/1987 | European Pat. Off. . |
| 0223972 A3 | 6/1987 | European Pat. Off. . |
| 0435817 A1 | 7/1991 | European Pat. Off. . |
| 23 83785 | 10/1978 | France . |
| 25 55 993 | 6/1977 | Germany . |
| 29 51 649 A1 | 7/1981 | Germany . |
| 40 04 597 A1 | 8/1991 | Germany . |
| 5-050587 | 3/1993 | Japan . |
| 295179 | 9/1982 | United Kingdom . |
| 2262716 | 6/1993 | United Kingdom . |

OTHER PUBLICATIONS

European Patent Office Communication for European Patent Application No. 941111257.5 with attached European Search Report dated Nov. 21, 1994.

European Patent Office Communication for European Patent Application No. 96100387.8 with attached European Search Report dated Apr. 12, 1996.

*Primary Examiner*—J. Reed Fisher

*Attorney, Agent, or Firm*—Armstrong, Westerman, Hattori, McCleland & Naughton

[57] ABSTRACT

An inking arrangement for printing presses comprises an ink fountain member having at least one fountain-forming face for forming an ink fountain, an ink fountain roller defining an ink channel together with the fountain member and having an outer peripheral surface to be inked through the channel, a plurality of rollers for supplying the ink applied to the peripheral surface of the fountain roller to a printing portion, and a cleaning tank disposed below the fountain member. The cleaning tank is provided with a cleaning blade at least alternatively shiftable to a cleaning position in which the blade is pressed against the peripheral surface of the fountain roller, or to a stand-by position in which the blade is away from the fountain roller. The ink applied to the peripheral surface of the fountain roller through the channel is scraped off by the blade in the cleaning position and collected in the tank.

22 Claims, 8 Drawing Sheets

INKING ARRANGEMENT FOR PRINTING PRESSES

This application is a Division of prior application Ser. No. 08/559,176 filed Nov. 13, 1995, now U.S. Pat. No. 5,823,110 which in turn is a continuation-in-part of Ser. No. 08/277,066 filed Jul. 19, 1994 (abandoned).

BACKGROUND OF THE INVENTION

The present invention relates to inking arrangements for printing presses.

Usual printing presses have an ink fountain roller disposed close to an ink fountain member forming an ink fountain, from which ink is applied to the outer peripheral surface of the fountain roller, then transferred by a vibrating roller to an ink distributing roller and further supplied to the printing surface via a plurality of other ink distributing rollers.

The ink fountain member, which is usually in the form of a plate, and the fountain roller define an ink channel, through which the ink in the fountain is applied to the otuer peripheral surface of the fountain roller.

With the printing press described, the kind of ink to be used is changed depending on the print to be made. In such a case, completion of the preceding printing operation is followed by a procedure for replacing the ink within the fountain by the one to be used for the subsequent printing operation. This replacement procedure includes collection of the old ink from inside the fountain and cleaning of the fountain member and the rollers.

With the conventional printing press, the vibrating roller and the ink distributing rollers are automatically cleaned by so-called inker cleaning, whereas the fountain roller and the fountain member are difficult to clean automatically and are therefore cleaned manually in the following manner. After the preceding printing operation has been completed, the old ink remaining in the fountain is removed by manual work with the fountain roller at rest, and the portions of the fountain roller and the fountain member in contact with the ink are manually cleaned. Accordingly, the old ink is cumbersome to collect, and the fountain member and the fountain roller need to be cleaned by hand, necessitating similarly cumbersome work. Since it is only after these components have been cleaned that new ink can be placed into the fountain, the replacement is a time-consuming procedure and requires a long period of time before starting the next printing operation.

There are also cases wherein the size (width) of the ink channel is altered depending on the print to be produced by the printing machine. In such a case, the size of the ink channel is adjusted conventionally by varying the position or angle of the fountain member, but the adjustment is also cumbersome.

Furthermore it is desired with the printing press to adjust the width of the ink fountain in accordance with the width of the printing surface, whereas this is generally difficult.

SUMMARY OF THE INVENTION

An object of the present invention is to an inking arrangement for printing presses which makes it easy to collect old ink and to clean the fountain roller to shorten the replacement time.

Another object of the invention is to provide an inking arrangement for printing presses which obviates the need to clean the fountain member for the replacement of ink to shorten the replacement time.

Another object of the invention to provide an inking arrangement for printing presses wherein the ink channel is easy to adjust in size.

Still another object of the invention is to provide an inking arrangement for printing presses wherein the ink fountain is easy to adjust in width.

The present invention provides an inking arrangement for printing presses which comprises an ink fountain member having at least one fountain-forming face for forming an ink fountain, an ink fountain roller defining an ink channel together with the fountain member and having an outer peripheral surface to be inked through the channel, a plurality of rollers for supplying the ink applied to the peripheral surface of the fountain roller to a printing portion, and a cleaning tank disposed below the fountain member, the ink arrangement being characterized in that the cleaning tank is provided with a cleaning blade at least alternatively shiftable to a cleaning position in which the cleaning blade is pressed against the peripheral surface of the fountain roller or to a stand-by position in which the cleaning blade is away from the fountain roller so that the ink applied to the peripheral surface of the fountain roller through the channel is scraped off by the cleaning blade in the cleaning position and collected in the cleaning tank.

When a usual printing operation is to be conducted, the cleaning blade is changed over to the stand-by position away from the fountain roller. Accordingly, the ink applied from the ink fountain to the peripheral surface of the fountain roller through the ink channel is supplied to the printing surface as in the prior art. For the replacement of ink, the cleaning blade is changed over to the cleaning position and pressed against the peripheral surface of the fountain roller. In this state, the fountain roller is rotated. The rotation of the fountainer roller causes the old ink remaining in the fountain to come out through the ink channel onto the outer peripheral surface of the fountain roller as in the case of printing, whereas the ink is scraped off by the cleaning blade and collected in the cleaning tank. After the whole ink remaining in the fountain has been taken out by the fountain roller and collected by the cleaning blade into the cleaning tank, the fountain roller is held in rotation as it is for some time, whereby the ink remaining on the peripheral surface of the fountain roller is almost completely scraped off by the cleaning blade. When required, the portions of the fountain roller peripheral surface and the fountain member which were in contact with the ink are thereafter thoroughly cleaned manually, a new ink is placed into the fountain, and the next printing operation is stated. In this way, the ink remaining in the fountain is automatically collected into the cleaning tank by the cleaning blade in the cleaning position, and the ink remaining on the fountain roller peripheral surface scraped off almost completely by the blade for the replacement of the ink. The surfaces of the fountain roller and the fountain member only need to be cleaned by hand when so desired. Consequently, the present invention makes it easy to collect the ink and clean the arrangement to result in a shortened replacement time.

For example, the fountain member is positionable in a plurality of work positions by being rotated about an axis of rotation parallel to the fountain roller, and has a plurality of fountain-forming faces arranged along the periphery thereof in the direction of rotation and each having an ink channel-defining portion at one end thereof. Each of the fountain-forming faces forms the ink fountain with its channel-defining portion positioned close to the peripheral surface of the fountain roller when the fountain member is in the corresponding work position. In this case, for example, the fountain member is approximately in the form of a quadrangular prism and has four fountain-forming faces along its periphery. Further for example, the plurality of fountain-forming faces are different from one another in the distance from the axis of rotation of the fountain member to the channel-defining portion. Further for example, the positioning angle of the fountain member in each of the work positions is finely adjustable.

When an ink of different kind is to be used to produce a different print, the fountain-forming face which forms the ink fountain can be replaced by rotating the fountain member and positioning the member in a differnt work position. For the replacement of ink, therefore, the fountain member is rotated to the different work position to form the ink fountain with a fresh fountain-forming face for use in the next printing operation, and the new ink is placed into the fountain, whereby the next printing operation can be initiated before cleaning the fountain-forming face used for the preceding printing operation. The fountain-forming face used for the preceding operation can be cleaned during the next printing operation. Accordingly, the time required for the replacement can be shortened by the length of time needed for cleaning the fountain-forming face. In the case where the fountain member is in the form of a quadrangular prism, a plurality of fountain-forming faces can be easily formed along the periphery of the fountain member which has a simple shape. In the case where the channel-defining portions of the fountain-forming faces are different from one another in the distance from the axis of rotation of the fountain member to the channel-forming portion, different work positions give different sizes to the ink channel. When the positioning angle of the fountain member in each work position is made finely adjustable, the size of the ink channel can be finely adjusted in each work position by finely adjusting the positioning angle.

For example, the fountain roller and the fountain member are each at least partly made of a magnetic material, and the inking arrangement further comprises barrier plates each including a permanent magnet having a face for magnetically attracting the fountain roller in intimate contact with the peripheral surface thereof and a face for magnetically attracting the fountain member in intimate contact with the fountain-forming face forming the ink fountain.

In this case, the barrier plates can be installed in place and removed easily, and are shiftable longitudinally of the fountain roller. The width of the ink fountain is variable as desired by shifting the barrier plates. The barrier plates merely attract the fountain roller thereto magnetically and therefore cause no trouble to the rotation of the fountain roller. Even when having a plurality of fountain-forming faces, the fountain member is rotatable with the barrier plates removed from between the fountain roller and the fountain member.

For example, the inking arrangement comprises a strip of sheet which has a lengthwise intermeidate portion placed over the fountain member so as to cover the fountain-forming face in intimate contact there-with.

The term "sheet" as used herein includes all flexible materials which are thin plates having a very small thickness as compared the length and width thereof. The sheet is not limited in thickness; the term sheet includes a sheet having a relatively large thickness and a film having a small thickness.

When the arrangement including the sheet is used for usual printing,the sheet portion covering the fountain-forming face of the fountain member is in intimate contact with the face and remains immovable in any direction. The fountain-forming face covered with the sheet and the fountain roller form an ink fountain, in which ink is placed. One end of the fountain-forming face covered with the sheet and the fountain roller define an ink channel. When the fountain roller is rotated in this state, the ink in the fountain comes out onto the peripheral surface of the fountain roller through the ink channel. As in the prior art, the ink applied to the surface of the fountain roller is supplied to the printing surface. For the replacement of ink, the old ink remaining in the fountain is collected, the ink remaining on the fountain roller peripheral surface is scraped off almost completely, and the fountain roller is cleaned by hand when required. On the other hand, the sheet is moved longitudinally thereof, whereby the sheet portion so far in use in intimate contact with the fountain forming face and having the old ink adhering thereto is moved away from the fountain-forming face, and a fresh sheet portion before use is brought into intimate contact with the fountain-forming face. The fresh sheet portion and the fountain roller form an ink fountain, into which a new ink is placed, and the next printing operation is conducted as described above. Since the fountain-forming face of the fountain member is covered with the sheet, no ink will adhere to the face. For replacement, the sheet needs only to be so moved as to move the used sheet portion away from the fountain-forming face and to bring the fresh sheet portion before use into intimate contact with the face without the necessity of cleaning the fountain member. This ensures a simple replacement procedure and takes a shorter period of time.

The inking arrangement includes, for example, roll support means for rotatably supporting the sheet as rolled up before use and take-up means for winding up the sheet after use. The sheet is paid off from the roll on the support means, placed over the fountain member and guided to the take-up means.

In this case, a predetermined length of sheet needs only to be wound up by the take-up means to pay off the sheet from the roll on the support means for the replacement of ink, whereby the used sheet portion can be moved away from the fountain-forming face, with the unused sheet portion brought into intimate contact with the fountain-forming face.

For example, the roll support means has a roll support member in the form of a trough for supporting the roll thereon.

The sheet roll can then be rotatably supported when merely placed into the support member.

For example, the take-up means has a hollow or solid cylindrical take-up member for winding the sheet thereon, and a drive device for rotating the take-up member. For example in this case, the take-up member is removably mounted on the drive device, and the take-up member is formed in its outer peripheral surface with a groove for the leading end of the sheet to be fixedly inserted in. The groove extends to at least one end of the take-up member.

The sheet can then be wound up on the take-up member merely by rotating the take-up member with the drive device, merely with the leading sheet end inserted in the groove of the take-up member. The entire sheet as wound up on the take-up member can be removed from the member easily for disposal by slipping the roll off in the direction in which the groove extends to the take-up member end.

For example, the fountain member is positionable in a plurality of work positions by being rotated about an axis parallel to the fountain roller, and has a plurality of fountain-forming faces arranged along the periphery thereof in the direction of rotation and each having an ink channel-defining portion at one end thereof, each of the fountain-forming faces forming the ink fountain with its channel-defining portion positioned close to the peripheral surface of the fountain roller when the fountain member is in the corresponding work position, the channel-defining portions being different from one another in the distance from the axis of rotation of the foundation member to the channel-defining portion.

In this case, the distance from the axis of rotation of the fountain member to the channel defining portion can be easily altered merely by rotating the fountain member and thereby changing the work position, whereby the size of the ink channel can be varied.

For example, the fountain roller and the fountain member are each at least partly made of a magnetic material and the inking arrangement further comprises barrier plates including a permanent magnet having a face for magnetically attracting the fountain roller in intimate contact with the peripheral surface thereof and a face snugly fittable to the fountain-forming face forming the ink fountain with the sheet interposed therebetween to magnetically attract the fountain member.

The barrier plates can be installed in place and removed easily, and the width of the ink fountain is variable as desired by shifting the barrier plates longitudinally of the fountain roller. The barrier plates can be removed when the sheet is placed over the fountain member or moved. The barrier plates merely attract the fountain roller thereto magnetically and therefore cause no trouble to the rotation of the fountain roller. Even when having a plurality of fountain-forming faces, the fountain member is rotatable with the barrier plates removed from between the fountain roller and the fountain member.

DESCRIPTION OF THE PREFERRED EMBODIMENTS

Several embodiments of the invention will be described below with reference to the drawings.

FIGS. 1 to 5 show a first embodiment.

Figure 1:
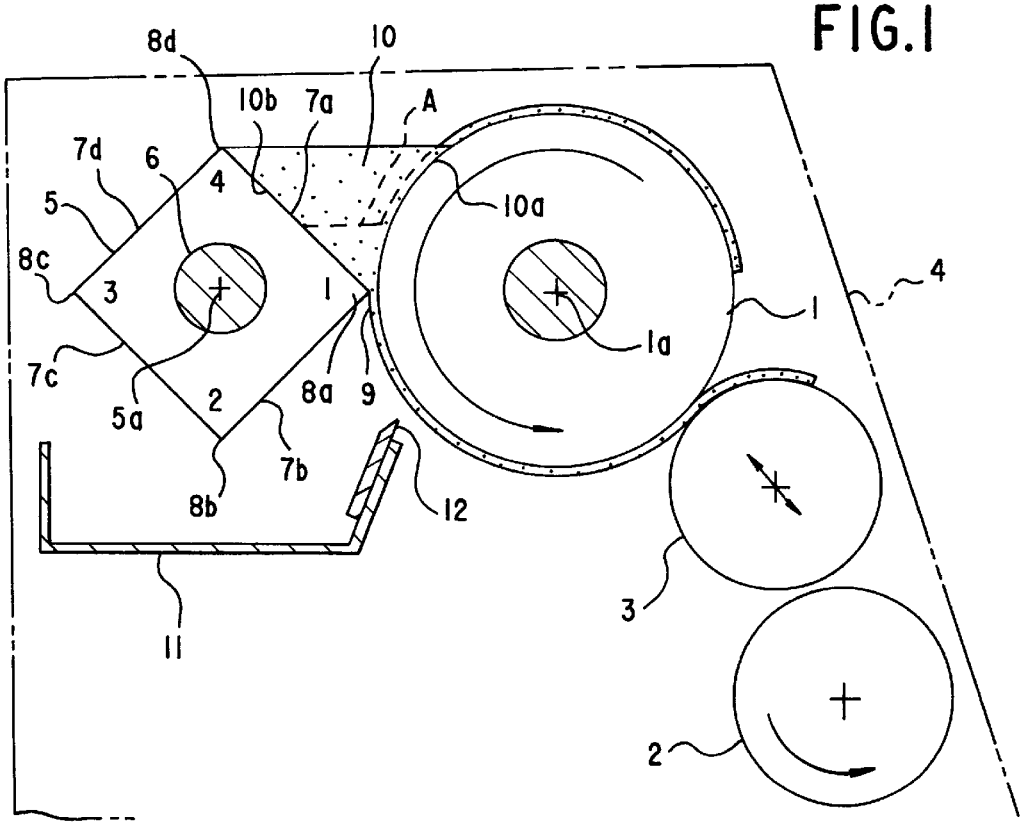
FIG. 1 is a side elevation partly broken away and showing the main portion of a printing press inking arrangement as a first embodiment of the invention.
Figure 3:
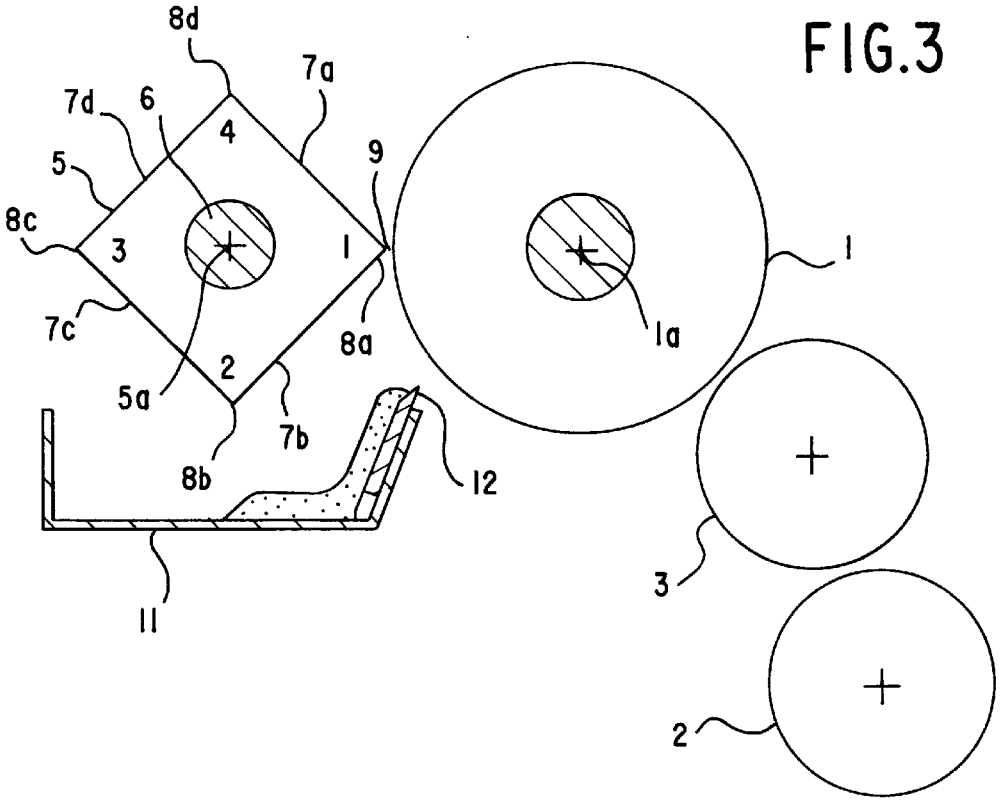
FIG. 3 is a side elevation partly broken away and corresponding to FIG. 1 to show the same in a state different from that shown in FIG. 2.
Figure 4:
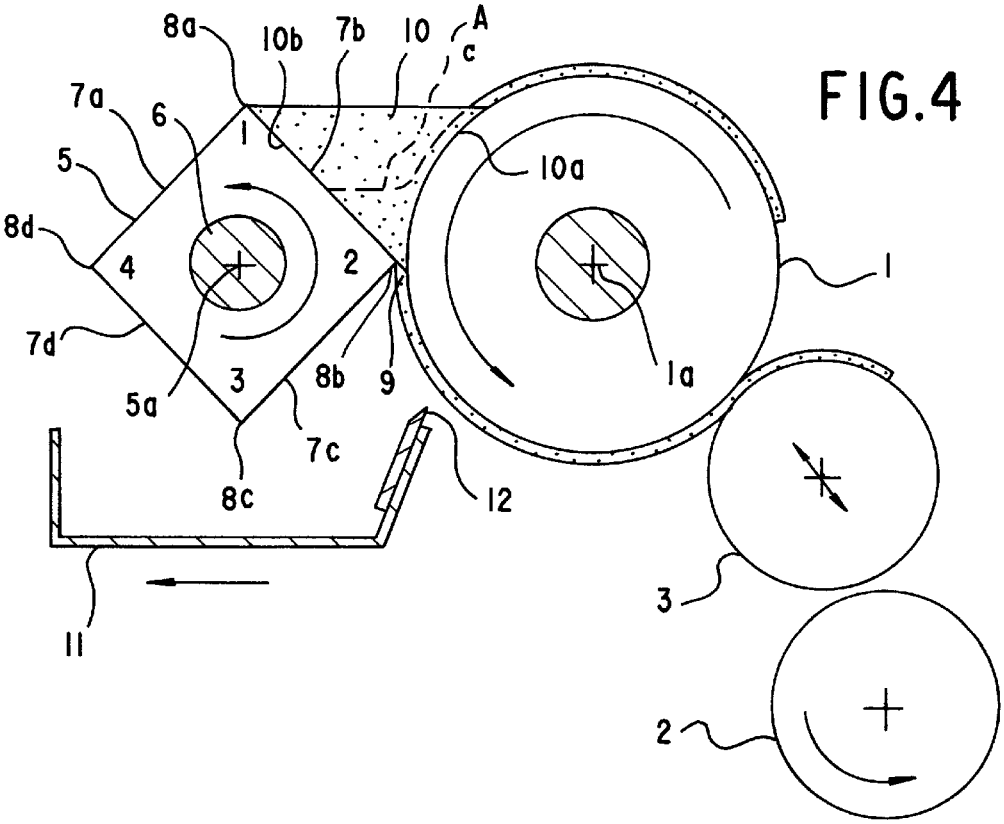
FIG. 4 is a side elevation partly broken away and corresponding to FIG. 1 to show the same in a state different from that shown in FIG. 1.
Figure 5:
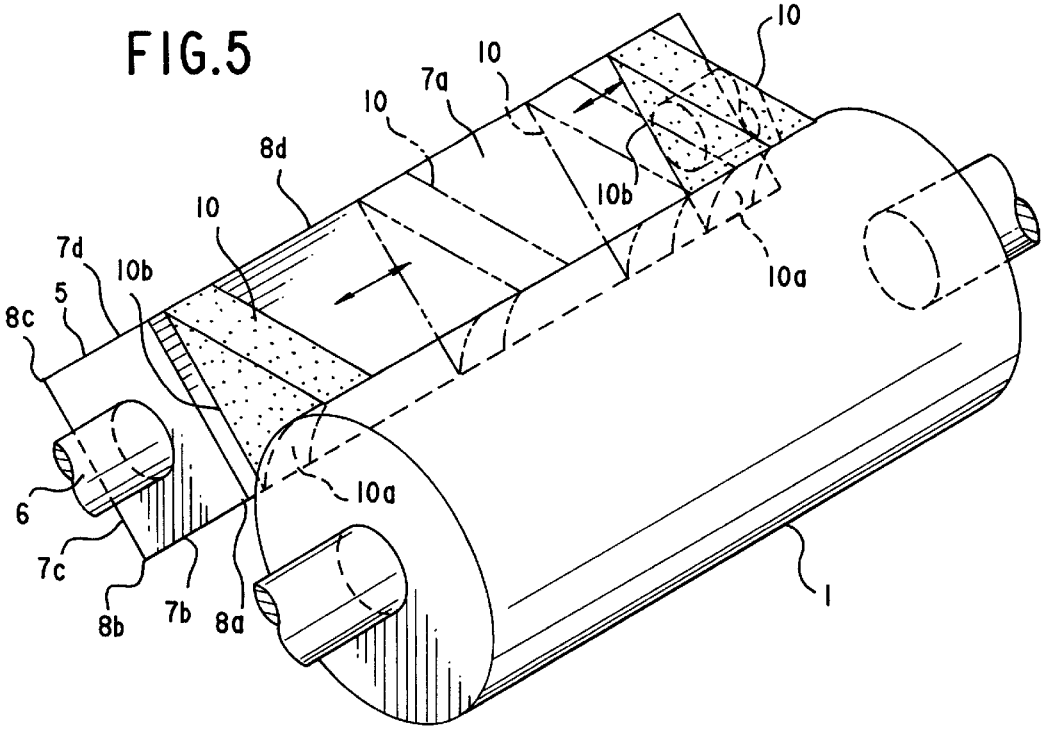
FIG. 5 is a perspective view showing the main portion of FIG. 1.
Figure 6:
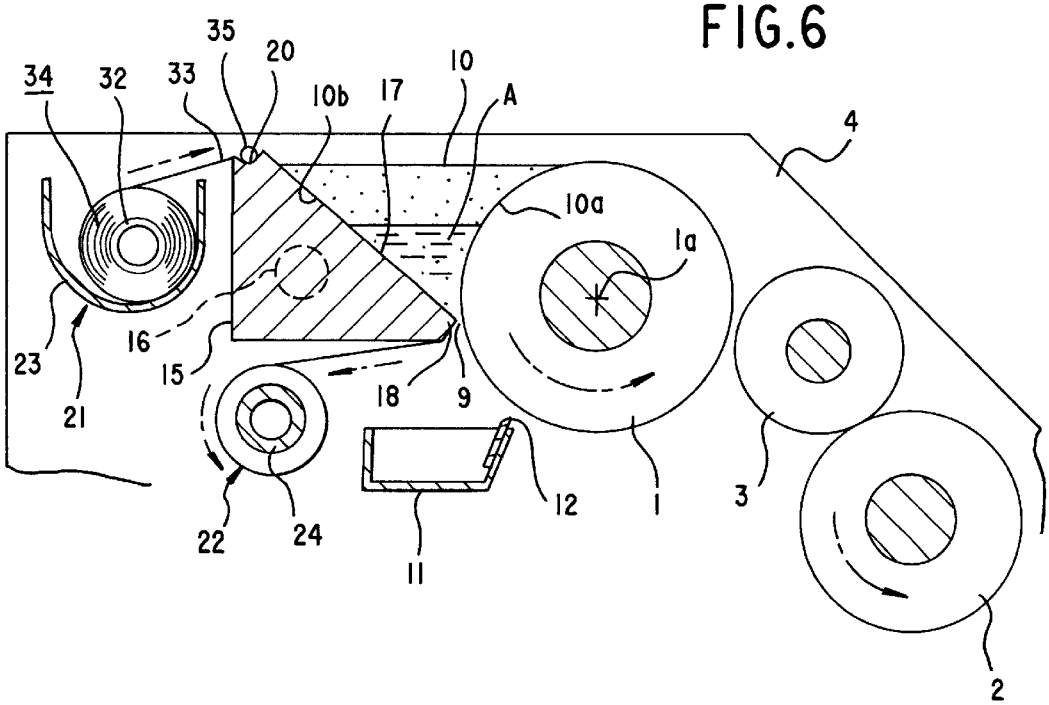
FIG. 6 is a side elevation partly broken away and showing the main portion of another printing press inking arrangement as a second embodiment of the invention.
Figure 7:
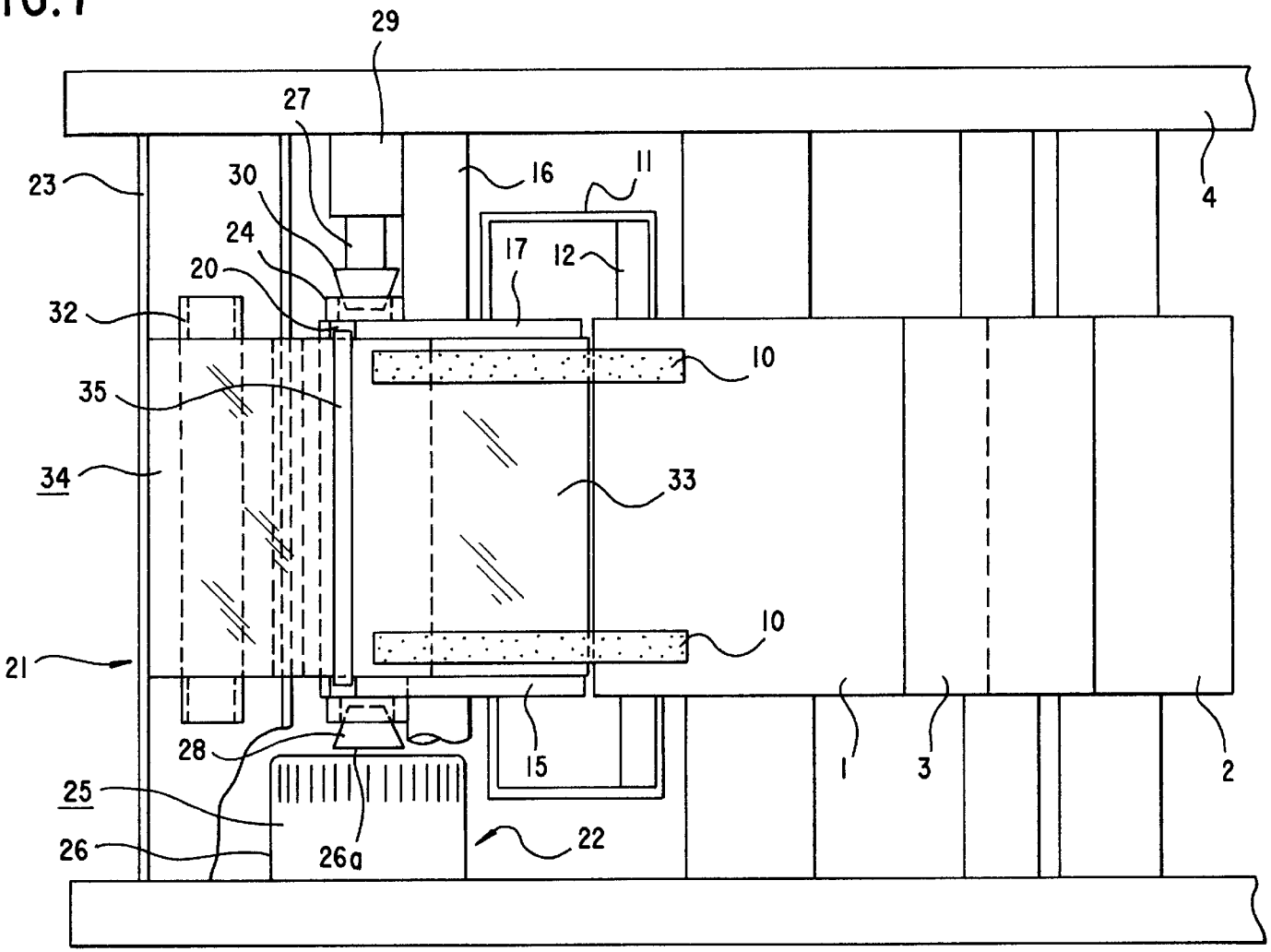
FIG. 7 is a plan view partly broken away of FIG. 6.

FIGS. 1 to 4 show the main portion of a printing press inking arrangement in four different states, respectively, and FIG. 5 is an enlarged fragmentary view of the same in the state of FIG. 1. In the following description of the first embodiment, the right-hand side of FIGS. 1 to 4 will be referred to as the "front," and the left-hand side thereof as the "rear." The terms "right" and "left" are used for arrangement as it is seen from the front rearward. More specifically, the front side of the plane of FIGS. 1 to 4 will be referred to as "left," and the rear side thereof as "right." Further the direction of rotation will be expressed with reference to FIGS. 1 to 4.

An ink fountain roller 1 extends horizontally in the right-left direction. Disposed in front of and below this roller is the first of a plurality of ink distributing rollers, i.e., roller 2, in parallel to the roller 1. A vibrating roller 3 is disposed between these rollers 1 and 2 in parallel thereto. The fountain roller 1 and the distributing roller 2 are rotatably supported at their opposite ends by a press frame 4 and are rotated at a predetermined speed in synchronism with each other in the direction of arrows shown by an unillustrated suitable drive device. At least the outer peripheral portion of the fountain roller 1 is made of a magnetic material, and the peripheral surface thereof can be attracted by a permanent magnet. Although not shown in detail, the vibrating roller 3 is alternatively shiftable by a suitable change-over device to a position where the roller 3 is away from the distributting roller 2 and in contact with the fountain roller, or to a position where it is away from the fountain roller 1 and in contact with the distributing roller 2. Such an arrangement of vibrating roller 3 and distributing roller 2 is known and therefore will not be described in detail.

An ink fountain member 5 made of magnetic material and extending horizontally in the tight-left direction is disposed in the rear of the fountain roller 1. The fountain member 5 is, for example, in the form of a quadrangular prism having a square cross section, and is provided with a support shaft portion 6 extending outward from each of its opposite ends and rotatably supported by the frame 4. The fountain member 5 is rotatable in a desired direction, for example, by hand and positionable in four work positions at an angular spacing of 90 deg and can be fixed in each work position by an unillustrated lock pin or like suitable means. The four laterals faces of the fountain member 5 along its periphery serve as fountain-forming faces 7*a*, 7*b*, 7*c*, 7*d*. The lateral edges at the clockwise ends of the fountain-forming faces 7*a* to 7*d* serve as ink channel-defining portions 8*a*, 8*b*, 8*c*, 8*d* corresponding to the respective fountain-forming faces 7*a* to 7*d*. These fountain-forming faces will be designated collectively by the reference numeral 7, and when there airses a need to make distinction, these faces will be referred to as the first fountain forming face 7*a*, second fountain-forming face 7*b*, third fountain-forming face 7*c* and fourth fountain-forming face 7*d* as arranged clockwise in order. Similarly, the ink channel-defining portions will be designated collectively by the reference numeral 8, and when there is a need for distinction, these portions will be referred to as the first ink channel-defining portion 8*a*, second ink channel-defining portion 8*b*, third ink channel-defining portion 8*c* and fourth ink channel-defining portion 8*d* in the order of clockwise arrangement. The illustrated end face of the fountain member 5 is marked with the numerals 1 to 4 in corresponding relation with the channel-defining portions 8 to represent the respective portions 8. Each fountain-forming face 7 form an ink fountain when the fountain member 5 is positioned in the corresponding work position, and the channel-defining portion 8 corresponding to the face 7 is positioned close to the peripheral surface of the fountain roller 1 to define an ink channel 9 together with the fountain roller 1. The work position in which the first fountain-forming face 7*a* forms the ink fountain as shown in FIG. 1 will be referred to as the first work position, and the work position in which the second fountain-forming face 7*b* forms the ink fountain as shown in FIG. 4 will be referred to as the second work position. Similarly, the work position in which the third fountain-forming face 7*c* forms the ink fountain will be referred to as the third work position, and the work position in which the fourth fountain-forming face 7*d* forms the ink fountain will be referred to as the fourth work position. The size of the ink channel 9 is dependent on the distance between the axis 1*a* of rotation of the fountain roller 1 and the axis 7*a* of rotation of the fountain member 5, the diameter of the fountain roller 1 and the distance from the axis 5*a* of rotation of the fountain member 5 to the ink channel-defining portion 8. In this case, at least two channel-forming portions 8 are different in the distance from the axis 7*a* of rotation of the fountain member 5 to the channel-defining portion 8. Different work positions are then made different in the size of the ink channel 9.

A pair of right and left barrier plates 10 serving as the side plates of the ink fountain are removably fixed in a space between the fountain roller 1 and the fountain member 5. Each barrier plate 10 comprises a permanent magnet and approximately triangular in shape. The portions corresponding to the two sides of the triangle are formed with a face 10*a* in the form of a portion of cylinder for attracting the fountain roller thereto, and a planar face 10*b* for attracting the fountain member thereto, respectively. The barrier plates 10 are removed from the fountain roller 1 and the fountain member 5 when the fountain member 5 is to be rotated. During printing, the roller attracting face 10*a* is in intimate contact with the peripheral surface of the fountain roller 1, magnetically attracting the roller thereto, and the fountain member attracting face 10*b* is in intimate contact with the fountain-forming face 7 which is forming the ink fountain, magnetically attracting the member thereto, whereby the barrier plates 10 are fixed in position by these roller and member to constitute the side plates of the fountain. At this time, the barrier plates 10 hold the fountain roller 1 merely attracted thereto magnetically and are therefore unlikely to cause trouble to the rotation of the fountain roller 1. Further because the barrier plates 10 magnetically attract the fountainer roller 1 and the fountain member 5, the plates are easy to install and remove, and interchangeable for use. In conformity with the width of the printing surface, the barrier plates 10 are shiftable longitudinally of the roller and the member, whereby the width of the ink fountain is variable. The barrier plate 10 is integrally formed, for example, of a metal magnet, plastics magnet, rubber magnet or the like. Alternatively, the barrier plate 10 may comprise a main body made of a suitable material, and a permanent magnet fixed to the main body and providing the roller attracting face 10*a* and the member attracting face 10*b*.

Figure 2:
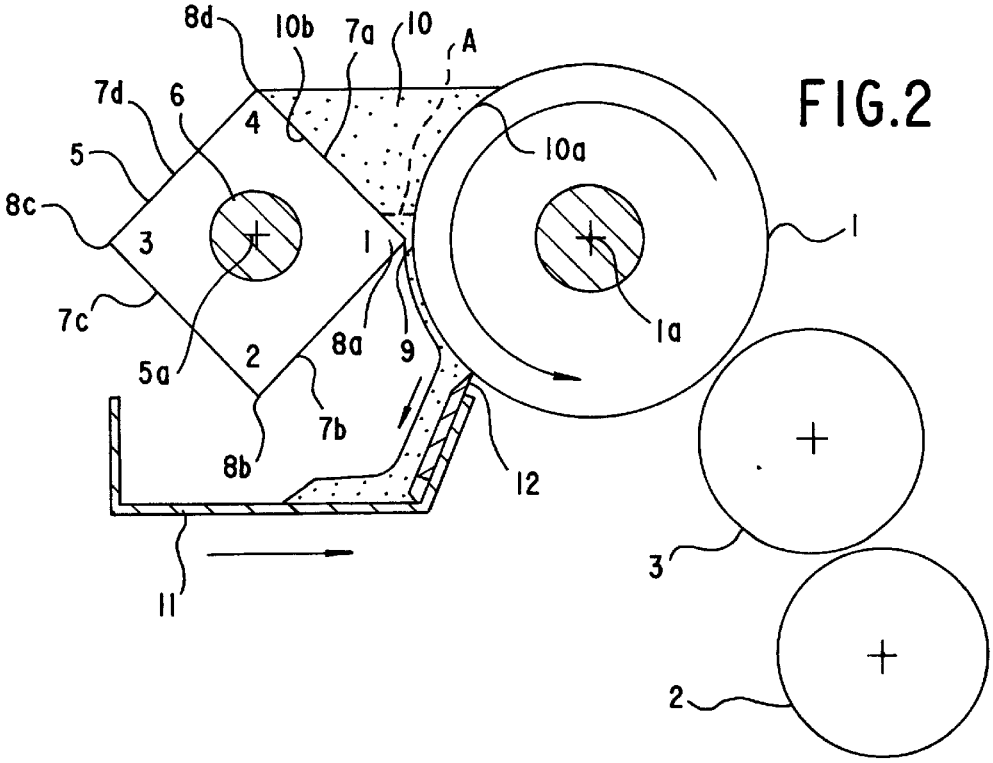
FIG. 2 is a side elevation partly broken away and corresponding to FIG. 1 to show the arrangement in a state different from that shown in FIG. 1.

A cleaning tank 11 is disposed below the fountain member 5. The tank 11 has a cleaning blade 12 fixed to its front portion and projecting obliquely forwardly upward from the front end thereof. The blade 12 is made, for example, of a resilient steel plate having a thickness of about 0.5 mm. The width in the right-left direction of the tank 11 and the blade 12 is slightly larger than the length of the fountain roller 1. The tank 11 is supported so as to be movable forward and rearward by a, for example, air cylinder 40, as more fully discussed below with respect to FIGS. 12 through 15. The tank 11 is alternatively movable forward to a cleaning position in which the blade 12 is in pressing contact with the peripheral surface of the fountain roller 1 as seen in FIG. 2, or rearward to a stand-by position in which the blade 12 is away from the fountain roller 1 as shown in FIG. 1.

When the printing press according to the first embodiment operates for printing, the tank 11 is in the rearward stand-by position, the fountain member is fixed in one of the work position, and the barrier plates 10 are fixed in the space between the fountain roller 1 and the fountain member 5. An ink A is then placed into the ink fountain formed by the fountain member, fountain roller 1 and opposite barrier plates 10. FIG. 1 shows the fountain member 1 as fixed in the first work position.

When the fountain roller 1 rotates in the state shown in FIG. 1, the ink A in the fountain comes out onto the peripheral surface of the fountain roller 1 through the ink channel 9. The ink applied to the surface of the roller 1 is transferred to the outer peripheral surface of the vibrating roller 3 while the roller 3 positioned in contact with the fountain roller 1 upon a change-over. The ink is then transferred from the vibrating roller 3 to the ink distributing roller 2 while the roller 3 is positioned in contact with the roller 2 upon a change-over. The ink is further supplied to the printing surface via the other ink distributing rollers. The amount of ink to be supplied to the printing surface is adjusted by controlling the period of time during which the vibrating roller 3 is in contact with the fountain roller 1.

When the printing operation in the first work position is to be followed by another printing operation in the second work position, for example, the following replacement procedure is executed.

When the printing operation in the first work position has been completed, the tank 11 is first shifted to the forward cleaning position to press the blade 12 against the surface of the fountain roller 1, and the fountain roller is rotated in this state as seen in FIG. 2. This causes the ink A remaining in the fountain to come out through the ink channel 9 onto the peripheral surface of the fountain roller 1 as in the printing operation, whereas the ink is scraped off by the blade 12 and collected in the tank 11. After the whole ink A remaining in the fountain has been taken out by the roller 1 and collected by the blade 12 into the tank 11, the fountain roller 1 is held in rotation as it is for some time, whereby the ink remaining on the peripheral surface of the fountain roller 1 is almost completely scraped off by the blade 12. As seen in FIG. 3, the tank 11 is thereafter shifted to the rearward stand-by position, the fountainer roller 1 is stopped, the opposite barrier plates 10 are removed, and when required, the peripheral surface of the fountain roller 1 is thoroughly cleaned. When the roller 1 has been cleaned, the fountain member 5 is rotated through 90 deg counterclockwise and fixed in the second work position as shown in FIG. 4, a pair of new barrier plates 10 are thereafter fixed in position, a new ink A is placed into the fountain and the next printing operation is started.

At a suitable time after the completion of the preceding printing operation and before the next printing operation is initiated, the vibrating roller, ink distributing roller 2, etc. are cleaned in the same manner as in the prior art by inker cleaning. Further after the next printing operation has been started, the old ink collected in the tank 11 is discarded, and the barrier plates 10 and the first fountain-forming face 7*a* used for the preceding operation are cleaned.

With the printing press described, the ink remaining in the fountain is automatically collected after the completion of the printing operation into the tank 11, and the ink remaining on the peripheral surface of the fountain roller 1 scraped off almost completely. Accordingly, the surface of the fountain roller 1 and the fountain-forming face 7*a* only need to be cleaned by hand as required. The present arrangement therefore ensures facilitated cleaning work and a shortened replacement time. Before the first fountain-forming face 7*a* used for the preceding operation is cleaned, the fountain member 5 is rotated to the second work position to start the next printing operation, and the fountain-forming face 7*a* can be cleaned during the next printing operation. Consequently, the replacement time can further be shortened by the length of time needed for cleaning the first face 7*a*.

The fountain member 5, tank 11, blade 12, etc. are not limited to those of the above embodiment in construction but can be modified suitably. With the foregoing embodiment, the distances from the axis 5*a* of rotation of the fountain member 5 to at least two channel-defining portions 8 are made different to give different sizes to the ink channel 9 in different work positions. However, in the case where there is no need to alter the size of the ink channel 9 for different work positions, the distances from the axis 5*a* of the fountain member 5 to all the channel-defining portions 8 may be made equal. In addition to this modification, the positioning angle of the fountain member 5 in each work position may be made finely adjustable. The position of the channel-defining portion 8 can then be finely adjusted to finely adjust the size of the ink channel 9, by finely adjusting the positioning angle in each work position. Furthermore, the positioning angle of the fountain member 5 in each work position may be made finely adjustable while making at least two channel-defining portions 8 different in the distance from the axis 5*a* to the portion 8 as in the foregoing embodiment. For example, the fountain member 5 may be automatically rotated by a suitable drive device. The fountain member 5 may be, for example, approximately in the form of a triangular prism having an approximately regular triangular cross section to form three fountain-forming faces along its peripheray so as to be fixed in three work positions at an angular spacing of 120 deg. Furthermore, the fountain member may be in the form of a plate having two fountain-forming faces on opposite sides thereof so as to be fixed in two work postiions spaced apart by 180 deg. Although the tank 11 is movable forward and rearward in its entirety to shift the blade 12 upon a change-over according to the embodiment described, only a portion including the blade may be made shiftable.

FIGS. 6 to 10 show a second embodiment. Throughout FIGS. 1 to 10, like parts are designated by like reference numerals.

Figure 8:
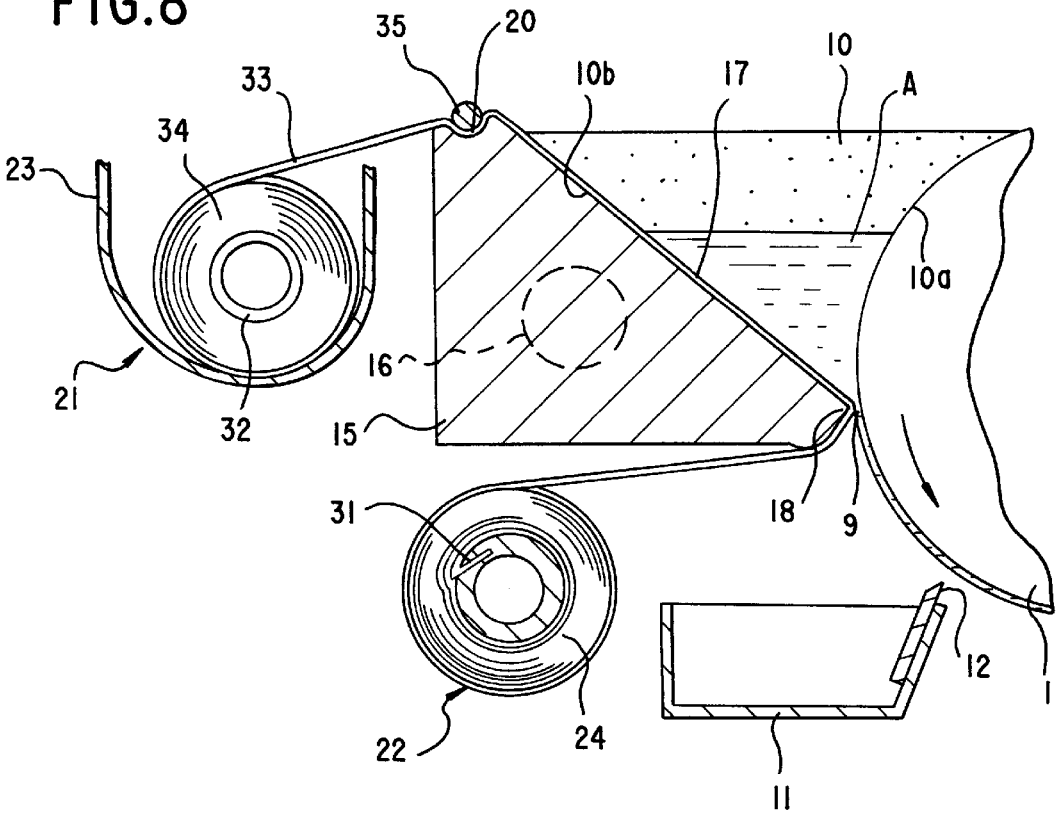
FIG. 8 is a side elevation partly broken away and showing part of FIG. 6 on an enlarged scale.
Figure 9:
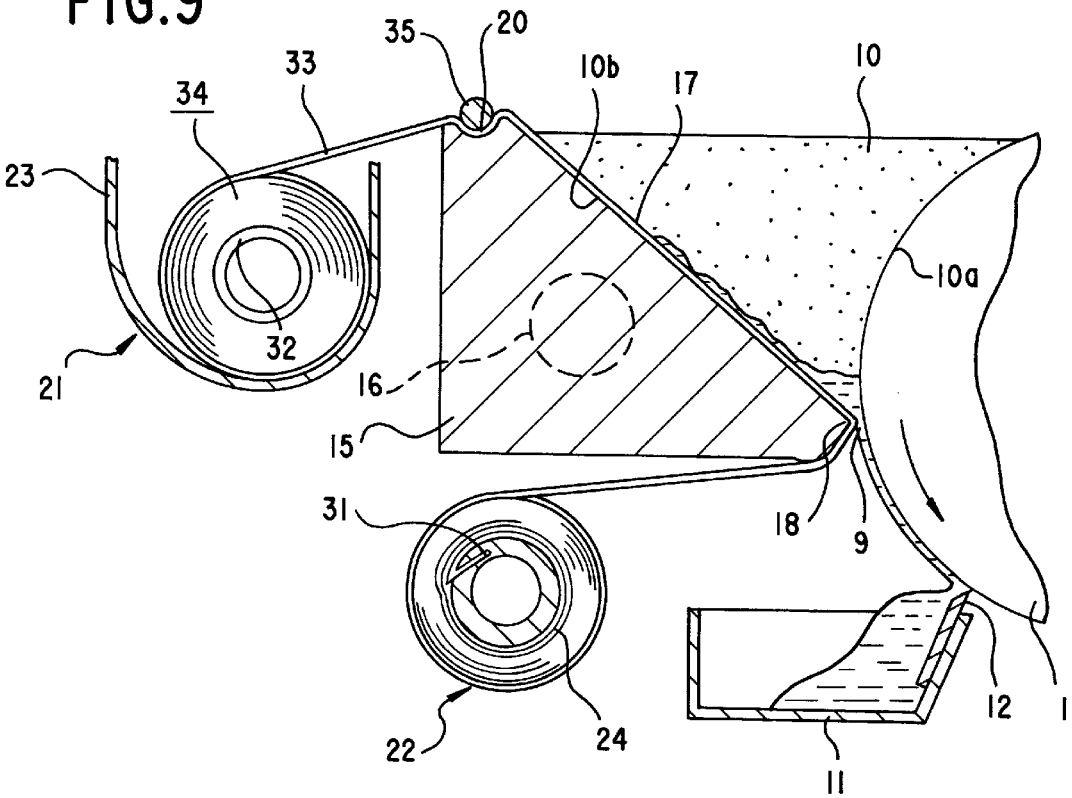
FIG. 9 is a side elevation partly broken away and corresponding to FIG. 8 to show the same in a state different that shown in FIG. 8.
Figure 10:
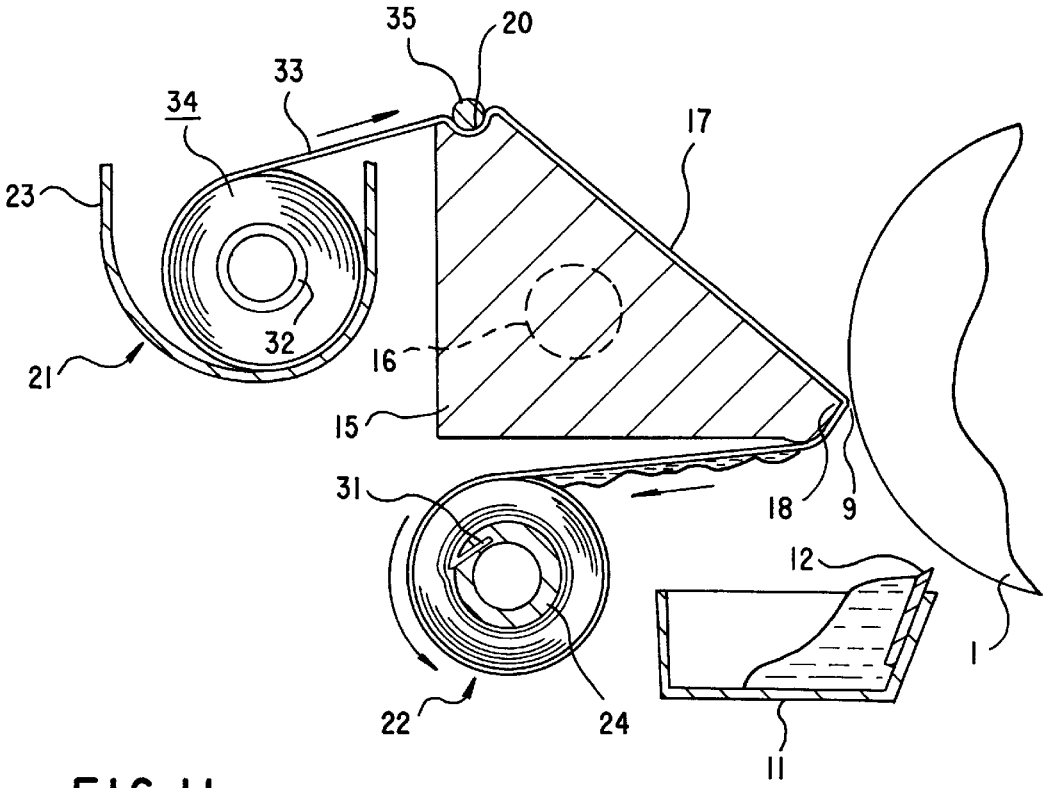
FIG. 10 is a side elevation partly broken away and corresponding to FIG. 8 to show the same, in a state different from that shown in FIG. 9.

FIGS. 6 to 10 show the main portion of another printing press inking arrangement. FIGS. 8 to 10 are enlarged fragmentary views showing the arrangement in three different states. In the following description of the second embodiment, the right-hand side of FIGS. 6 and 7 will be referred to as the "front," and the left-hand side thereof as the "rear." The terms "right" and "left" are used for the arrangement as it is seen from the front rearward. More specifically, the front side of the plane of FIG. 6 (lower side of FIG. 7) will be referred to as "left," and the rear side thereof (upper side of FIG. 7) as "right." Further the direction of rotation will be expressed with reference to FIG. 6.

The second embodiment has an ink fountain member 15 made of magnetic material and extending horizontally in the right-left direction. The member 15 is disposed in the rear of approximately upper half portion of a fountain roller 1. The fountain member 15 is, for example, in the form of a triangular prism and is provided at opposite ends thereof with support shaft portions 16 fixed respectively to opposite frames 4. The fountain member 15 has a face extending obliquely rearwardly upward and serving as a fountain-forming face 17. The face 17 has at its front end (lower end) a lateral edge serving as an ink channel-defining portion 18. The fountain roller 1 and the fountain-forming face 17 form an ink fountain. The channel-defining portion 18 is positioned close to the outer peripheral surface of the fountain roller 1 for the roller 1 and the portion 18 define an ink channel 9. Preferably, the fountain member 15 is rotated about the shaft portions 16 to finely adjust the positioning angle thereof and to thereby finely adjust the size of the ink channel 9. An upper face having a small width in the front-rear direction is formed at the upper end portion of the fountain member 15 between the upper end of the fountain-forming face 17 and the upper end of a substantially vertical rear face of the member 15. A groove 20 semicircular in cross section is formed in the upper face over the entire length thereof.

Roll support means 21 is disposed in the rear of the fountain member 15, and sheet take-up means 22 is provided under an approximately rear-half portion of the fountain member 15.

The roll support means 21 has a roll support member 23. The support member 23 is in the form of a trough extending horizontally in the right-left direction and has opposite ends fixed to the respective frames 4.

The sheet take-up means 22 has a sheet take-up member 24 and a drive device 25 therefor. The drive device 25 comprises an electric drive motor 26 and a support rotary shaft 27 which are opposed to each other and attached to the left and right frames 4, respectively. The motor 26 is mounted as directed rightward to the inner side of the left frame 4 and has a motor shaft 26*a* extending horizontally rightward. A conical bearing member 28 is secured to the right end of the shaft 26*a*. A support sleeve 29 extending horizontally leftward is fixed to the inner side of the right frame 4. A rotary shaft 27 extending horizontally leftward is rotatably and axially moably supported by the sleeve 29. The rotary shaft 27 is in alignment with the motor shaft 26*a* and fixedly carries a conical bearing member 30 at its left end. Although not shown, the rotary shaft 27 and the bearing member 30 are biased leftward by a spring or like elastic member provided inside the support sleeve 29. The take-up member 24 is in the form of a cylinder having a relatively large wall thickness and made of a suitable material such as aluminum or like metal or plastics. The take-up member 24 is fitted between the opposed bearing members 28, 30 and extends horizontall in the right-left direction. The forward end of each of the bearing members 28, 30 slightly fits in the end of the take-up member 24 opposed thereto and is pressed into contact with the inner peripheral edge of the end of the member 24. The motor 26, when driven in this state, rotates the take-up member 24 counterclockwise. The member 24 can be readily installed and removed by moving the shaft 27 and the bearing member 30 axially thereof. The take-up member 24 is formed in its peripheral surface with a groove 31 extending over the entire length thereof and terminating at opposite ends thereof. The groove 31 extends from the outer periphery of the member 24 toward the inner periphery thereof as inclined in a direction opposite to the direction of rotation, i.e., in a clockwise direction, with respect to the diametrical direction.

A sheet 33 made of plastics or the like is wound around a core tube 32 of paper or the like into a roll 34, which is freely rotatably accommodated in the support member 23. The sheet 33 paid off from the roll 34 in the support member 23 is placed over the fountain member 15 to cover the fountain-forming face 17 and then guided to the take-up means 22. The leading end of the sheet 33 is fixed to the take-up member 24 by being inserted in the groove 31. A tensioning member 35 comprising a metal or like round bar is fitted in the groove 20 of the fountain member 15 with the sheet 33 interposed between the member 35 and the grooved face. The take-up member 24 is rotated in the direction of arrow shown, whereby the sheet 33 is wound up on the take-up member 24, causing the roll 34 to rotate within the support member 23 and to pay off a fresh portion of the sheet 33. With the sheet 33 locally nipped between the tensioning member 35 and the wall face of the fountain member 15 defining the groove 20, predetermined tension is imparted to the sheet 33 between the nipped portion and the take-up member 24, whereby the portion of the sheet 33 covering the fountain-forming face 17 is held in intimate contact with the face 17. In actuality, the fountain roller 1 and the portion of the sheet 33 covering the fountain-forming face 17 form an ink fountain, and the portion of the sheet 33 in intimate contact with the channel-defining portion 18 and the fountain roller 1 define the ink channel 9.

The second embodiment includes barrier plates 10 which are the same as those of the first embodiment. The barrier plates 10 are removed from the fountain roller 1 and the fountain member 15 when the sheet 33 is to be placed over the fountain member 15 or to be moved. During printing, the fountain roller attracting face 10*a* attracts the roller 1 thereto in intimate contact with the roller peripheral surface, and the fountain member attracting face 10*b* snugly fits to the fountain-forming face 17 of the fountain member 15 with the sheet 33 interposed therebetween to attract the member 15 thereto, whereby the barrier plates 10 are fixed in position to provide the side plates of the ink fountain.

When the printing press of the second embodiment operates for printing, the tank 11 is in its rearward stand-by position as shown in FIG. 8, and the barrier plates 10 are fixedly positioned between the fountain roller 1 and the fountain member 15. The take-up member 24 is held at rest. The portion of sheet 33 in intimate contact with the fountain-forming face 17 remains immovable in either direction. An ink A is placed into the ink fountain formed by the sheet portion covering the face 17 of the fountain member 15, the fountain roller 1 and the opposed barrier plates 10. At this time, the fountain-forming face 17 is covered with the sheet 33 and is therefore held out of contact with the ink A.

The inking arrangement operates in the same manner as the first embodiment for printing.

When the printing operation is to be followed by the next printing operation, for example, the following replacement procedure is executed.

When the preceding printing operation has been completed, the tank 11 is first shifted to the forward cleaning position as shown in FIG. 9, and the fountain roller 1 is rotated, whereby the ink A remaining in the fountain is collected into the tank 11, and the ink remaining on the surface of the fountain roller 1 is almost completely scraped off as in the first embodiment. The tank 11 is thereafter shifted to the rearward stand-by position, the fountain roller 1 is stopped, the opposed barrier plates 10 are removed, and when required, the peripheral surface of the fountain roller 1 is thoroughly cleaned. As shown in FIG. 10, on the other hand, the take-up member 24 is rotated to move the sheet 33 longitudinally thereof while winding the sheet 33 on the member 24, whereby the portion of the sheet 33 used in intimate contact with the fountain-forming face 17 and having the old ink adhering thereto is moved toward the take-up member 24 out of contact with the face 17. This causes the roll 34 to pay off an unused fresh portion of the sheet 33, which is made to cover the face 17 in intimate contact therewith. When the used portion of the sheet 33 is released from the fountain-forming face 17 with the fresh portion thereof brought into intimate contact with the face 17, the take-up member 24 is halted. A pair of new barrier plates 10 is then fixed in the ink fountain, a new ink is placed into the fountain, and the next printing operation is conducted as previously stated.

At a suitable time after the completion of the preceding printing operation and before the start of the next operation, the vibrating roller 3, the distributing roller 2, etc. are cleaned by inker cleaning as in the prior art also in this case. After the start of the next printing operation, the old ink collected in the tank 11 is discarded, and the barrier plates 10 used for the preceding printing operation are cleaned.

When the sheet 33 has been entirely paid off from the roll 34 by repeating the printing operation for making different kinds of prints, the take-up member 24 is rotated to completely wind up the sheet 33. The take-up member 24 is then removed from between the opposed bearing members 28, 30, the sheet 33 is slipped off as wound up from the member 24 by pulling the sheet 33 longitudinally of the member 24, and the roll of sheet 33 only is discarded. Since the groove 31 having the leading end of the sheet 33 inserted therein extends to opposite ends of the take-up member 24, the sheet 33 can be readily slipped off by pulling the sheet in either direction. The take-up member 24 from which the sheet 33 has been removed is installed between the opposed bearing members 28, 30 again, and the subsequent printing operation is carried out in the same manner as described above using a fresh roll of sheet.

In the case of the printing press of the second embodiment as in the case of the first embodiment, the ink remaining in the fountain is automatically collected after the completion of the printing operation into the tank 11, and the ink remaining on the peripheral surface of the fountain roller 1 scraped off almost completely. Accordingly, the surface of the fountain roller 1 only needs to be cleaned by hand when so required. The arrangement therefore ensures facilitated cleaning work and a shortened replacement time. Since the fountain-forming face 17 of the fountain member 15 is covered with the sheet 33, no ink will adhere to the face 17. For replacement, the sheet 33 needs only to be so moved as to release the used sheet portion from the fountain-forming face 17 and to bring a fresh sheet portion before use into intimate contact with the face 17 without the necessity of cleaning the fountain member 15. This results in a further shortened replacement time.

The roll support means 21, the take-up means 22 and the means for tensioning the sheet 33 to hold the sheet in intimate contact with the fountain-forming face 17 are not limited to those of the above embodiment but can be modified suitably. For example, rotary shafts the same as the rotary shaft 27 of the take-up means 22 may be provided at the respective right and left sides of the roll support means so as to removably support the core tube 32 of the roll 34 with an elastic force acting between the shafts. If suitable resistance is given to the rotary shaft in this case, the sheet 33 can be thereby tensioned and held in intimate contact with the fountain-forming face 17. A sheet roll with a core tube, sheet roll having no core tube, or sheet not in the form of a roll may merely be placed in a suitable position of the printing press without providing particular roll support means. Although the drive device 25 rotates the take-up member 24 with a mtor 26 in the foregoing embodiment, the device may be one adapted to rotate the take-up member manually. The take-up member may be made, for example, of paper so as to be disposable along with the sheet wound thereon. The take-up member may be made supportable in a cantilever fashion so that the sheet wound thereon can be slipped off from the free end thereof. The used sheet portion may be guided into a disposal box disposed below the fountain assembly without providing the take-up means.

Figure 11:
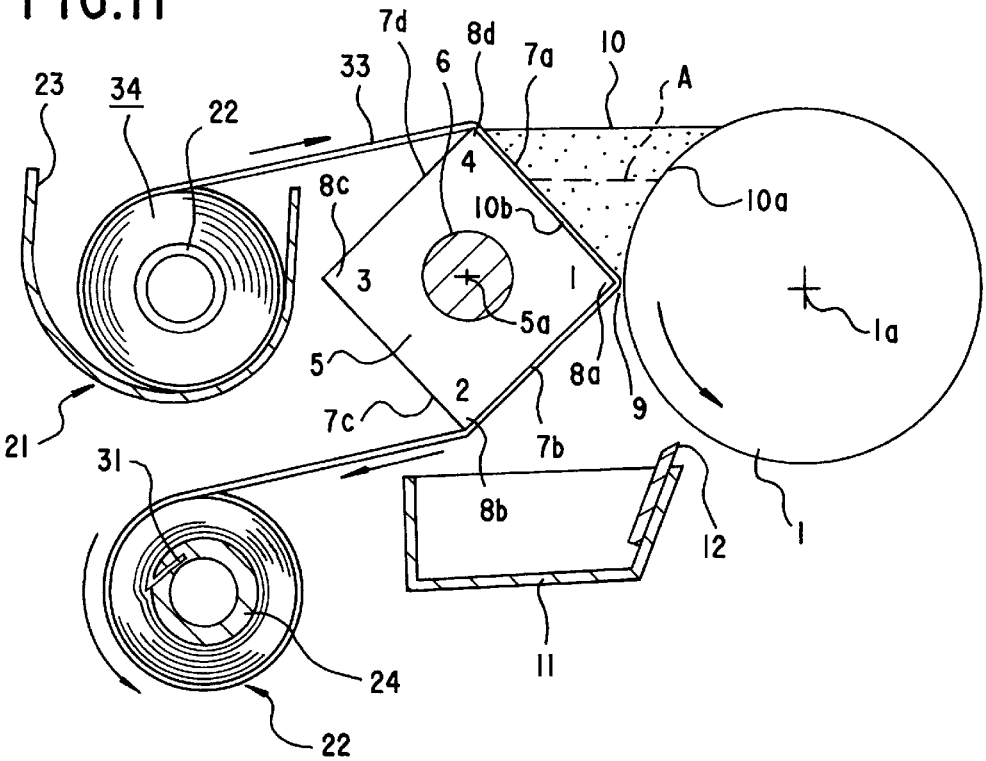
FIG. 11 is a side elevation partly broken away and showing the main portion of another printing press inking arrangement as a third embodiment of the invention.

FIG. 11 shows a third embodiment. Throughout the drawings showing the first to third embodiments, like parts are designated by like reference numerals or symbols.

The third embodiment differs from the second embodiment only in respect of the fountain member 5 and is otherwise the same as the second. The fountain member 5 of the third embodiment, although similar to the corresponding member of the first embodiment, has four ink channel-defining portions 8 which are different from one another in the distance from the axis 5*a* of rotation of the fountain member 5 to the channel-defining portion 8. Accordingly, all the work positions are different in the size of ink channel 9. Preferably, the angle of rotation of the fountain member 5 is finely adjustable to thereby finely adjust the size of the ink channel 0.

The sheet 33 is placed over the fountain member 5 so as to cover at least the fountain-forming face 7 in intimate contact therewith which face is forming an ink fountain. Although not shown in FIG. 11, suitable means is provided for holding the sheet in intimate contact with the fountain-forming face 7 by suitably tensioning the portion of the sheet 33 between the roll 34 and the take-up member 24. In actuality also in this case, the portion of sheet 33 covering the fountain-forming face 7 and the fountain roller 1 forms the ink fountain, and the portion of sheet 33 in intimate contact with the channel defining portion 8 and the fountain roller 1 defines the ink channel 9.

When the fountain member 5 is to be rotated, barrier plates 10 are removed from the fountain roller 1 and the fountain member 5. As in the second embodiment, the peripheral surface of the fountain roller 1 is attracted to the plates 10 magnetically, and the face 7 of the fountain member 7 forming the fountain is similarly attracted to the plates 10, with the sheet 33 interposed therebetween, whereby the barrier plates 10 are fixed to the roller 1 and the member 5 during printing.

The fountain member 5 is fixed in one of the work positions during printing, and the arrangement operates in the same manner as the second embodiment for printing.

When the first printing operation is to be followed by the next printing operation without the necessity of altering the size of the ink channel 9, the same replacement procedure as is the case with the second embodiment is executed after the completion of the first operation, with the fountain member 5 held fixed in the same work position.

If it is necessary to alter the size of the ink channel 9 for the printing operation to be conducted after the first operation, the work position is changed by rotating the fountain member 5 during the replacement procedure as is the case with the second embodiment.

With the third embodiment, the size of the ink channel 9 is readily variable by rotating the fountain member 5 and thereby changing the work position.

Even when having a plurality of fountain-forming faces, the fountain member is not limited to this member of the third embodiment in construction but can be modified suitably.

Figure 12:
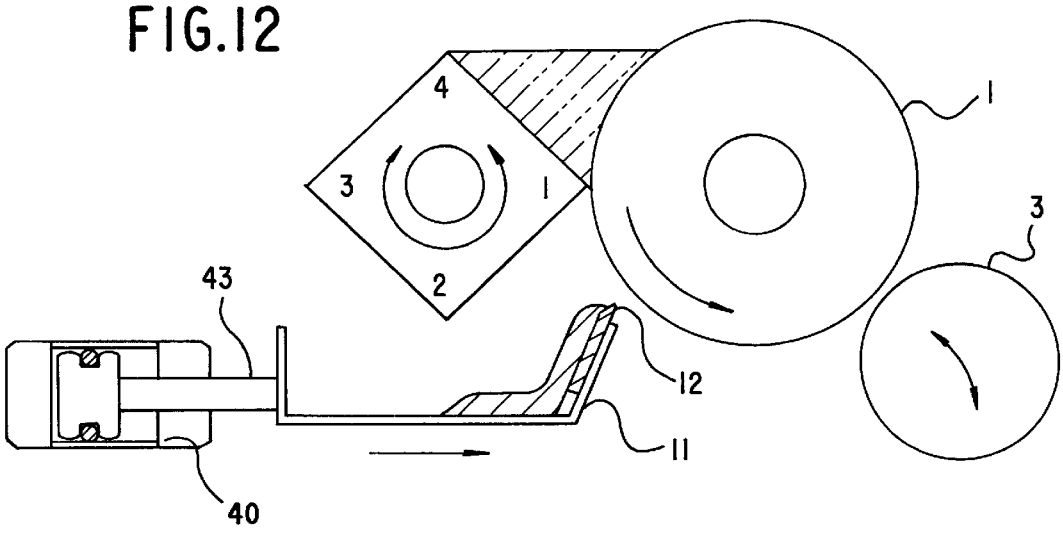
FIG. 12 is schematic view showing how an air cylinder is operably attached to a cleaning tank for withdrawing the tank, having a cleaning blade attached thereto, away from a fountain roller.
Figure 13:
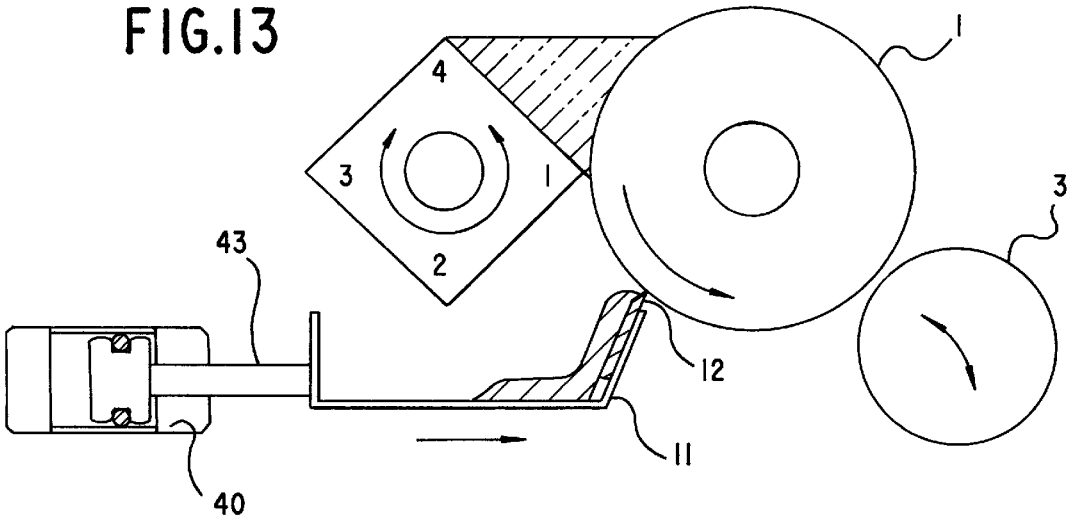
FIG. 13 is a schematic view showing how the air cylinder, operably attached to the cleaning tank, moves the tank, having the cleaning blade, forward towards the fountain roller.
Figure 14:
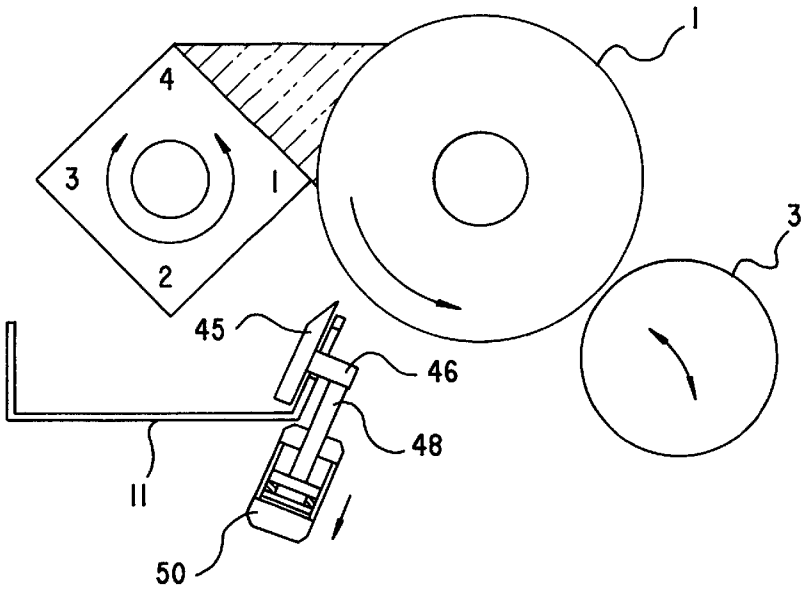
FIG. 14 is a schematic view showing how the air cylinder is operably coupled to the cleaning blade, which in turn is attached to the cleaning tank, for withdrawing the cleaning blade away from the fountain roller.

Although FIGS. 12 through 14 are shown with respect to the third embodiment (illustrated in FIG. 11), the manner in which the air cylinder 40 operates is similarly applicable to the first and second embodiments.

As shown in FIG. 12, the air cylinder 40 includes a shaft 43 which is preferably coupled to a rear portion of the cleaning tank II such that the shaft 43, when withdrawn, similarly withdraws the cleaning tank 11 which in turn withdraws the cleaning blade 12, attached thereto, from a pressing contact with the peripheral surface of the fountain roller 1. Upon the extension of the shaft 43 from the air cylinder 40, the tank 11 moves forward and the blade 12 attached thereto is capable of being in press contact with the peripheral surface of the fountain roller 1, as shown in FIG. 13.

Figure 15:
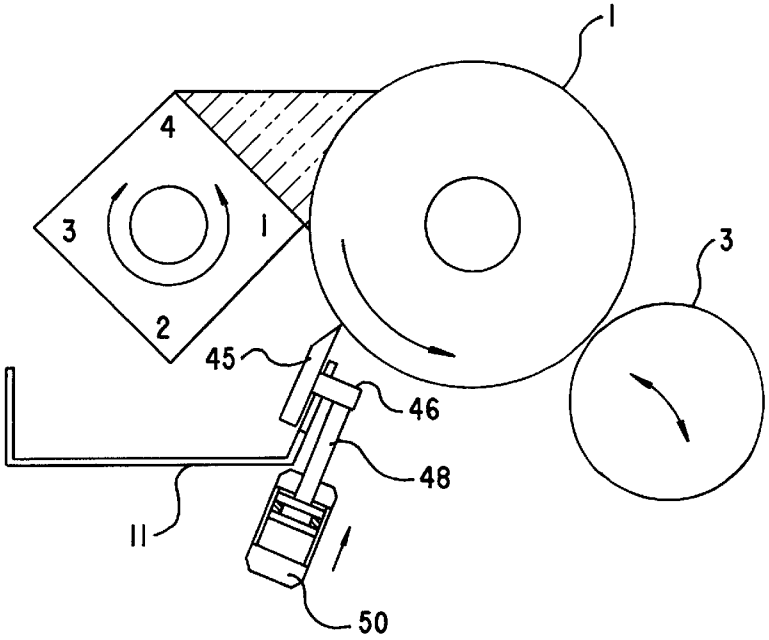
FIG. 15 is a schematic view showing how the air cylinder, operably coupled to the cleaning blade, moves the blade forward towards the fountain roller.

In yet another embodiment, as shown in FIGS. 14 and 15, a cleaning blade 45 is movable relative to the front portion of the cleaning tank 11, the cleaning blade 45 being attached to a connecting member 46, which in turn is connected to the shaft 48 of the air cylinder 50.

As shown in FIG. 14, when the shaft 48 of the air cylinder 50 is withdrawn, the connecting member 46 (attached thereto) and the cleaning blade 45 are similarly withdrawn. Consequently, the blade 45 is withdrawn from a pressing contact with the peripheral surface of the fountain roller 1. Upon the extension of the shaft 43 from the air cylinder 50, the connecting member 46 and the blade 45 move forward toward the fountain roller 1. As such, the blade 45 is capable of being in press contact with the peripheral surface of the fountain roller 1, as illustrated in FIG. 15.

In the case of the foregoing three embodiments, the fountain members 5, 15 each have such a simple configuration that a prismlike body is provided with support shaft portions 6 or 16 at its opposite ends integrally therewith, and are therefore easy to make with readily improved accuracy at a considerably reduced cost. However, the fountain members 5, 15 are not limited to those of a foregoing embodiments but can be, for example, conventional fountain members.

What is claimed is:

1. An inking arrangement for a printing press, comprising an ink fountain member having at least one fountain-forming face for forming an ink fountain;

an ink fountain roller defining an ink channel together with the fountain member and having an outer peripheral surface to be inked through the channel;

a plurality of rollers for supplying the ink applied to the peripheral surface of the fountain roller to a printing portion; and a cleaning tank disposed below the fountain member, wherein the cleaning tank is provided with a cleaning blade and at least one of said cleaning tank and said cleaning blade is operably coupled to a reciprocating device by a shaft, such that reciprocating action of said reciprocating device upon said shaft causes said cleaning blade to be at least alternatively shiftable to a cleaning position in which the cleaning blade is pressed against the peripheral surface of the fountain roller or to a stand-by position in which the cleaning blade is away from the fountain roller so that the ink applied to the peripheral surface of the fountain roller through the channel is scraped off by the cleaning blade in the cleaning position and collected in the cleaning tank, wherein the fountain member is positionable in a plurality of work positions by being rotated about an axis of rotation parallel to the fountain roller, and has a plurality of fountain-forming faces arranged along the periphery thereof in the direction of rotation and each having an ink channel-defining portion at one end thereof, each of the fountain-forming faces forming the ink fountain with its channel-defining portion positioned close to the peripheral surface of the fountain roller when the fountain member is in the corresponding work position.

2. An inking arrangement as defined in claim 1 wherein the fountain member is approximately in the form of a quadrangular prism and has four fountain-forming faces along its periphery.

3. An inking arrangement as defined in claim 1 wherein the plurality of fountain-forming faces are different from one another in the distance from the axis of rotation of the fountain member to the channel defining portion.

4. An inking arrangement as defined in claim 1 wherein the positioning angle of the fountain member in each of the work positions is finely adjustable.

5. An inking arrangement as defined in claim 1 wherein the fountain roller and the fountain member are each at least partly made of a magnetic material and which further comprises barrier plates including a permanent magnet having a face for magnetically attracting the fountain roller in intimate contact with the peripheral surface thereof and a face for magnetically attracting the fountain member in intimate contact with the fountain-forming face forming the ink fountain.

6. An inking arrangement as defined in claim 1 wherein a strip of sheet has a lengthwise intermediate portion placed over the fountain member so as to cover the fountain-forming face in intimate contact therewith.

7. An inking arrangement as defined in claim 6 which further comprises roll support means for rotatably supporting the sheet as rolled up before use and take-up means for winding up the sheet after use and wherein the sheet is paid off from the roll on the support means, placed over the fountain member and guided to the take-up means.

8. An inking arrangement as defined in claim 7 wherein the roll support means has a roll support member in the form of a trough for supporting the roll thereon.

9. An inking arrangement as defined in claim 7 wherein the take-up means has a hollow or solid cylindrical take-up member for winding the sheet there-on, and a drive device for rotating the take-up member.

10. An inking arrangement as defined in claim 9 wherein the take-up member is removably mounted on the drive device, and the take-up member is formed in its outer peripheral surface with a groove for the leading end of the sheet to be fixedly inserted in, the groove extending to at least one end of the take-up member.

11. An inking arrangement as defined in claim 6 wherein the fountain member is positionable in a plurality of work positions by being rotated about an axis parallel to the fountain roller, and has a plurality of fountain-forming faces arranged along the periphery thereof in the direction of rotation and each having an ink channel-defining portion at one end thereof, each of the fountain-forming faces forming the ink fountain with its channel-defining portion positioned close to the peripheral surface of the fountain roller when the fountain member is in the corresponding work position, the channel-defining portions being different from one another in the distance from the axis of rotation of the fountain member to the channel-defining portion.

12. An inking arrangement as defined in claim 6 wherein the fountain roller and the fountain member are each at least partly made of a magnetic material and which further comprises barrier plates including a permanent magnet having a face for magnetically attracting the fountain roller in intimate contact with the peripheral surface thereof and a face snugly fittable to the fountain-forming face forming the ink fountain with the sheet interposed therebetween to magnetically attract the fountain member.

13. An inking arrangement for a printing press, comprising:

an ink fountain member having at least one fountain-forming face for forming an ink fountain;

an ink fountain roller defining an ink channel together with the fountain member and having an outer peripheral surface to be inked through the channel;

a plurality of rollers for supplying the ink applied to the peripheral surface of the fountain roller to a printing portion;

a cleaning tank having a fixed cleaning blade attached thereto, the cleaning tank being disposed below the fountain member; and means operably coupled to the cleaning tank for shifting the cleaning tank between a cleaning position and a stand-by position, the cleaning position wherein the cleaning blade is pressed against the peripheral surface of the fountain roller at a downstream side in a travelling direction of the ink on the peripheral surface of the fountain roller from the ink channel and wherein the ink which is applied to the peripheral surface of the fountain roller through the ink channel is scraped off by the cleaning blade of the cleaning tank in the cleaning position and collected in the cleaning tank, the stand-by position wherein the cleaning blade is away from the fountain roller;

the fountain member being positionable in a plurality of work positions by being rotated about an axis of rotation parallel to the fountain roller, and having a plurality of fountain-forming faces arranged along the periphery thereof in the direction of rotation and each having an ink channel-defining portion at one end thereof, each of the fountain-forming faces forming the ink fountain with its channel-defining portion positioned close to the peripheral surface of the fountain roller when the fountain member is in the corresponding work position.

14. An ink arrangement as defined in claim 13, wherein the fountain member is approximately in the form of a quadrangular prism and has four fountain-forming faces along its periphery.

15. An ink arrangement as defined in claim 13, wherein the plurality of fountain-forming faces are different from one another in the distance from the axis of rotation of the fountain member to the channel-defining portion.

16. An ink arrangement as defined in claim 13, wherein a positioning angle of the fountain member in each of the work positions is finely adjustable.

17. An ink arrangement as defined in claim 13, wherein the fountain roller and the fountain member are each at least partly made of a magnetic material and which further comprises barrier plates including a permanent magnet having a face for magnetically attracting the fountain roller in intimate contact with the peripheral surface thereof and a face for magnetically attracting the fountain member in intimate contact with the fountain-forming face forming the ink fountain.

18. An inking arrangement for a printing press, comprising:

an ink fountain member having at least one fountain-forming face for forming an ink fountain;

an ink fountain roller defining an ink channel together with the fountain member and having an outer peripheral surface to be inked through the channel;

a plurality of rollers for supplying the ink applied to the peripheral surface of the fountain roller to a printing portion;

a cleaning tank having a shiftable cleaning blade attached thereto, the cleaning tank being disposed below the fountain member; and means operably coupled to the cleaning tank for shifting the cleaning blade between a cleaning position and a stand-by position, the cleaning position wherein the cleaning blade is pressed against the peripheral surface of the fountain roller at a downstream side in a travelling direction of the ink on the peripheral surface of the fountain roller from the ink channel and wherein the ink which is applied to the peripheral surface of the fountain roller through the ink channel is scraped off by the cleaning blade in the cleaning position and collected in the cleaning tank, the stand-by position wherein the cleaning blade is away from the fountain roller;

the fountain member being positionable in a plurality of work positions by being rotated about an axis of rotation parallel to the fountain roller, and having a plurality of fountain-forming faces arranged along the periphery thereof in the direction of rotation and each having an ink channel-defining portion at one end thereof, each of the fountain-forming faces forming the ink fountain with its channel-defining portion positioned close to the peripheral surface of the fountain roller when the fountain member is in the corresponding work position.

19. An ink arrangement as defined in claim 18, wherein the fountain member is approximately in the form of a quadrangular prism and has four fountain-forming faces along its periphery.

20. An ink arrangement as defined in claim 18, wherein the plurality of fountain-forming faces are different from one another in the distance from the axis of rotation of the fountain member to the channel-defining portion.

21. An ink arrangement as defined in claim 18, wherein a positioning angle of the fountain member in each of the work positions is finely adjustable.

22. An ink arrangement as defined in claim 18, wherein the fountain roller and the fountain member are each at least partly made of a magnetic material and which further comprises barrier plates including a permanent magnet having a face for magnetically attracting the fountain roller in intimate contact with the peripheral surface thereof and a face for magnetically attracting the fountain member in intimate contact with the fountain-forming face forming the ink fountain.

* * * * *